US007600348B1

(12) United States Patent
Kostka

(10) Patent No.: US 7,600,348 B1
(45) Date of Patent: Oct. 13, 2009

(54) BALLISTIC PROTECTION SHELTER

(75) Inventor: Frank Kostka, Newton, MA (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 376 days.

(21) Appl. No.: 11/582,779

(22) Filed: Oct. 18, 2006

(51) Int. Cl.

| | |
|---|---|
| ***B62D 63/04*** | (2006.01) |
| ***E04B 1/00*** | (2006.01) |
| ***E04B 1/12*** | (2006.01) |
| ***E04H 15/00*** | (2006.01) |
| ***E04H 15/18*** | (2006.01) |

(52) U.S. Cl. ..... 52/63; 52/3; 52/222; 89/36.01; 89/36.04; 135/97

(58) Field of Classification Search ..... 52/3, 52/63, 222; 89/36.01, 36.04; 135/97
See application file for complete search history.

(56) References Cited

U.S. PATENT DOCUMENTS

| | | | | |
|---|---|---|---|---|
| 2,890,498 | A | 6/1959 | Bigelow | |
| 3,010,462 | A | 11/1961 | Barber | |
| 3,596,977 | A | 8/1971 | Bunger | |
| 4,294,486 | A | 10/1981 | Espego | |
| 4,742,653 | A | 5/1988 | Napier et al. | |
| 5,822,936 | A * | 10/1998 | Bateman | 52/281 |
| 6,253,498 | B1 | 7/2001 | Fanucci | |
| 2005/0257479 | A1 * | 11/2005 | Nygren et al. | 52/584.1 |
| 2006/0107985 | A1 * | 5/2006 | Sovine | 135/96 |
| 2007/0039639 | A1 * | 2/2007 | Duncan | 135/97 |
| 2007/0180982 | A1 * | 8/2007 | Dagher et al. | 89/36.02 |

* cited by examiner

*Primary Examiner*—Richard E Chilcot, Jr.
*Assistant Examiner*—Branon C Painter
(74) *Attorney, Agent, or Firm*—Vincent J. Ranucci

(57) ABSTRACT

A ballistic protection shelter includes a soft-walled shelter structure wherein soft wall and soft roof portions are supported on at least one rigid support member, and an internal shelter structure for disposition within the soft-walled shelter structure. The internal shelter structure includes at least rigid side wall panels connectable to each other to form an enclosure. The panels are of a ballistic protective material adapted to provide protection to shelter occupants against explosive detonations and shrapnel.

5 Claims, 4 Drawing Sheets

BALLISTIC PROTECTION SHELTER

STATEMENT OF GOVERNMENT INTEREST

The invention described herein may be manufactured and used by the U.S. Government for governmental purposes without the payment of any royalty thereon.

BACKGROUND OF THE INVENTION

1. Field of the Invention

The invention relates to structures for human habitation and is directed more particularly to tent-like structures for use in the field, as by soldiers.

2. Description of the Prior Art

Soldiers in the field are typically housed in soft-walled structures, such as tents. Such structures usually include soft wall portions and soft roof portions connected together and supported by a pole, or a series of poles and/or frame members.

In a hostile environment, the occupants of such structures have little protection against detonations and consequent shrapnel. To improve protection under such conditions, high-value targets may be surrounded with concrete barriers and/or sand bags. Such external measures, however, readily identify to belligerents the high-value nature of the structures so enclosed.

Accordingly, there is a need for providing protection for soldiers in tents and other soft-walled structures, but in such a manner as to not reveal a priority target for belligerents.

SUMMARY OF THE INVENTION

An object of the invention is, therefore, to provide a ballistic protection shelter having the outside appearance of an ordinary tent and having internally thereof a shelter structure constructed of interconnectable rigid panels of a ballistic protective material.

With the above and other objects in view, as will hereinafter appear, a feature of the present invention is the provision of a ballistic protection shelter comprising a soft-walled shelter structure wherein soft wall and soft roof portions are supported on at least one rigid support member, and an internal shelter structure for disposition within the soft-walled shelter structure. The internal shelter structure comprises at least rigid side wall panels connectable to at least one of (1) each other, and (2) to the support member, to form an enclosure, the panels being of a ballistic protective material adapted to provide protection to shelter occupants against explosive detonations and shrapnel.

The system may also comprise interlocking rigid panels with lapped seams to maintain the integrity of the protective shielding and any sliding doors.

The above and other features of the invention, including various novel details of construction and combinations of parts, will now be more particularly described with reference to the accompanying drawings and pointed out in the claims. It will be understood that the particular shelter embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings:

FIG. 2 further shows a ballistic protection shelter illustrative of an embodiment of the invention;

DESCRIPTION OF THE PREFERRED EMBODIMENTS

Figure 1:
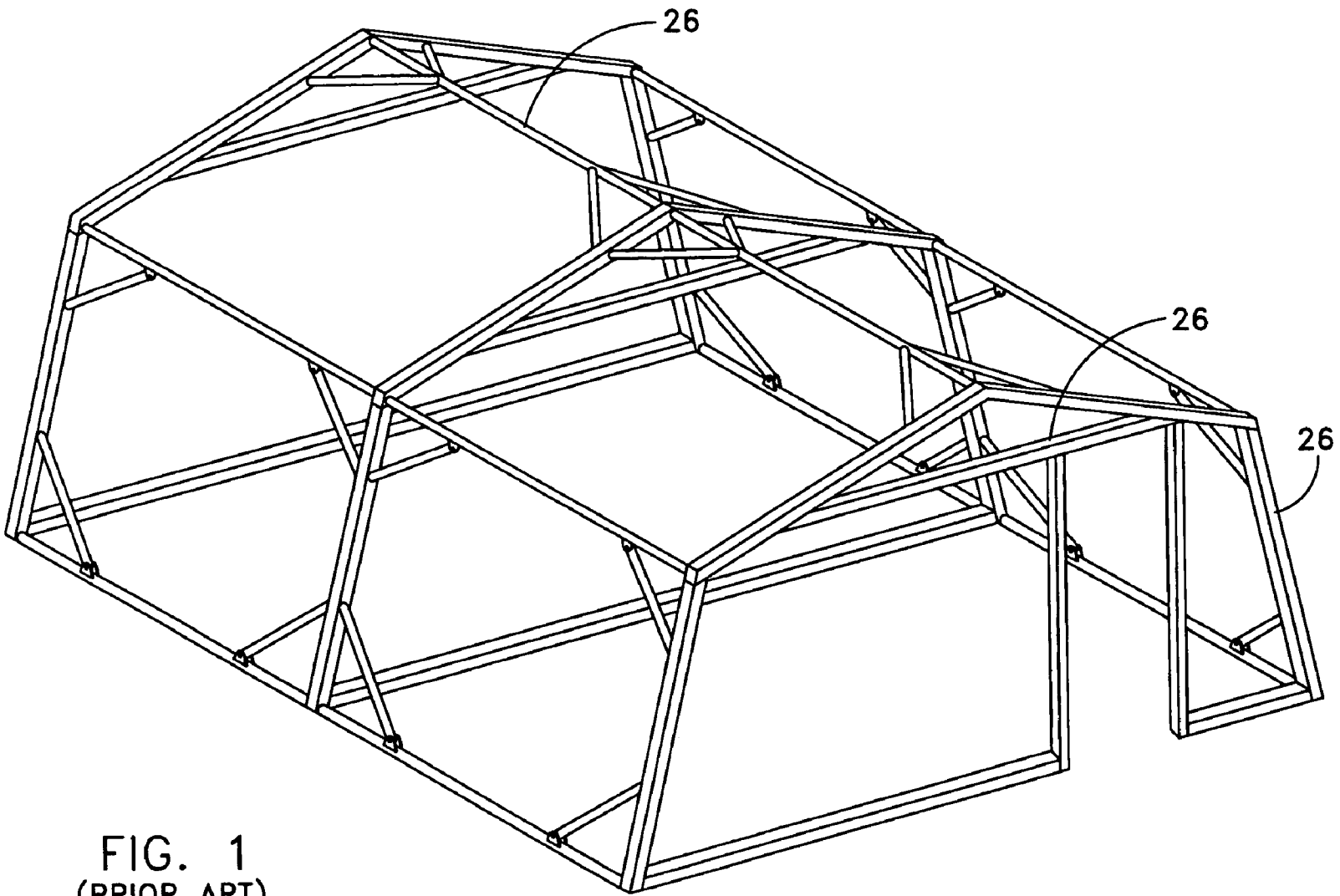
FIG. 1 (PRIOR ART)
FIG. 1 is a perspective view of one form of a frame assembly for supporting a soft wall and ceiling shelter structure.
Figure 2:
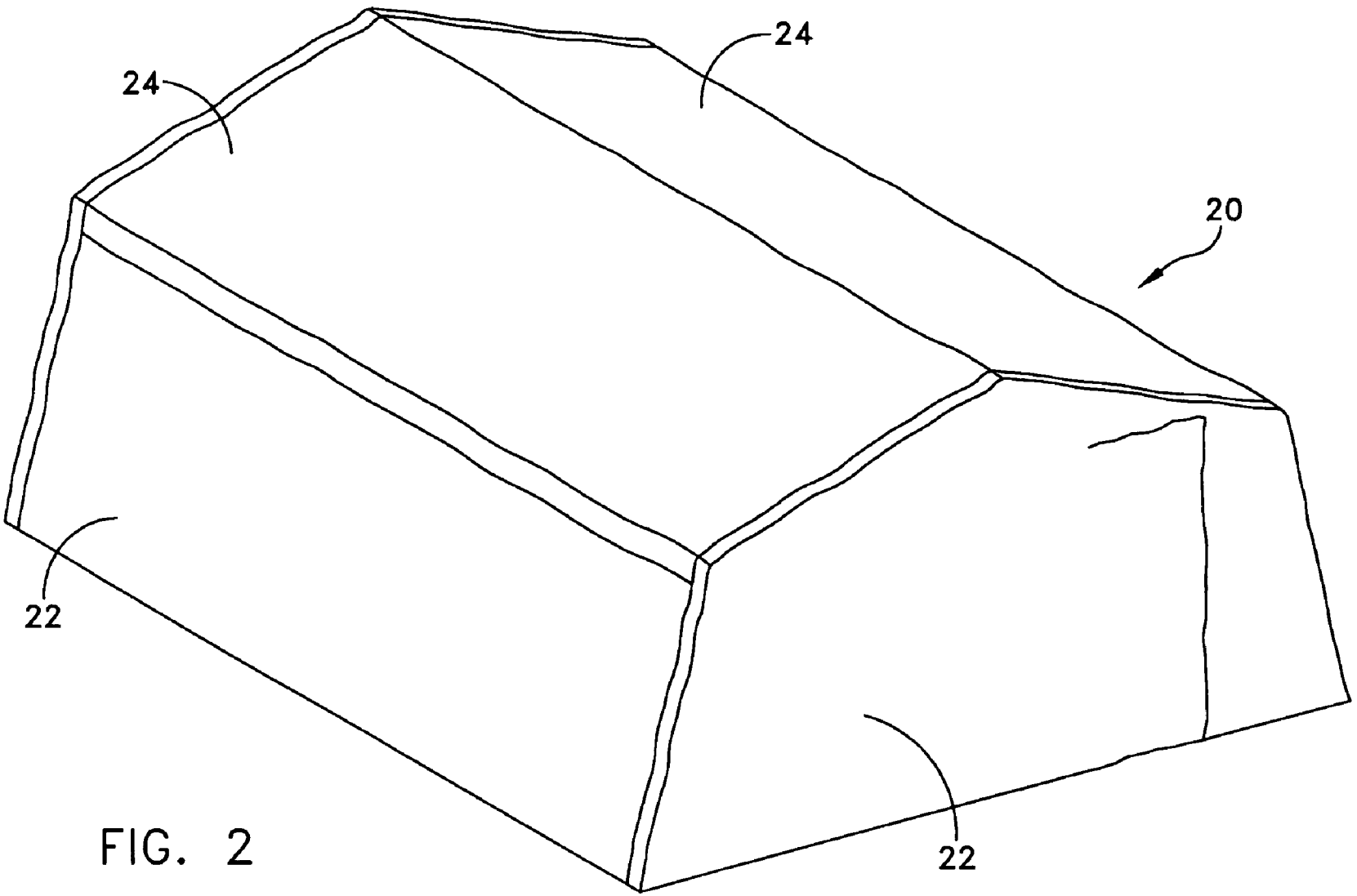
FIG. 2 is a perspective view of one form of a soft wall and ceiling structure mounted on the frame assembly of FIG. 1, or on a known alternative frame or pole structure.

Referring to FIG. 2, it will be seen that the illustrative ballistic protection shelter includes a soft-walled shelter structure, or tent, 20 having soft wall portions 22 and soft roof portions 24, supported by rigid poles or frame assembly 26 (FIG. 1).

Figure 3:
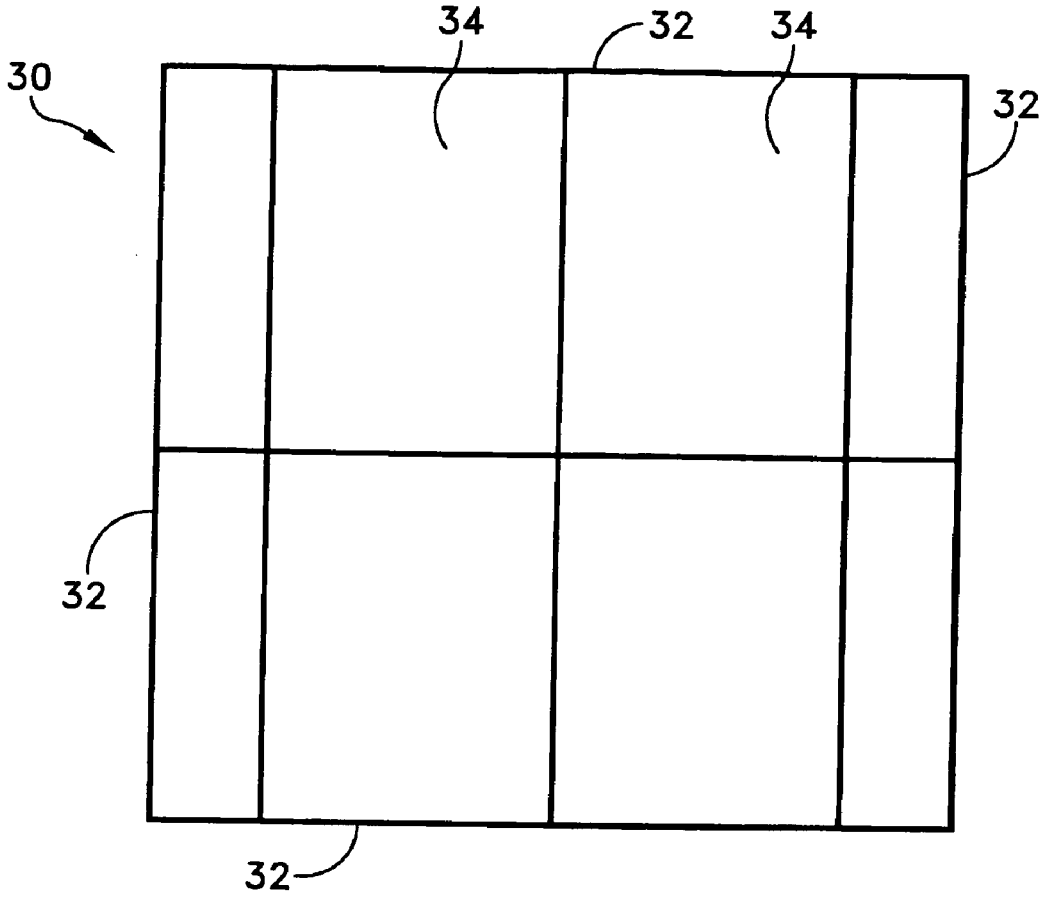
FIG. 3 is a top plan view of an inner portion of the shelter structure.
Figure 5:
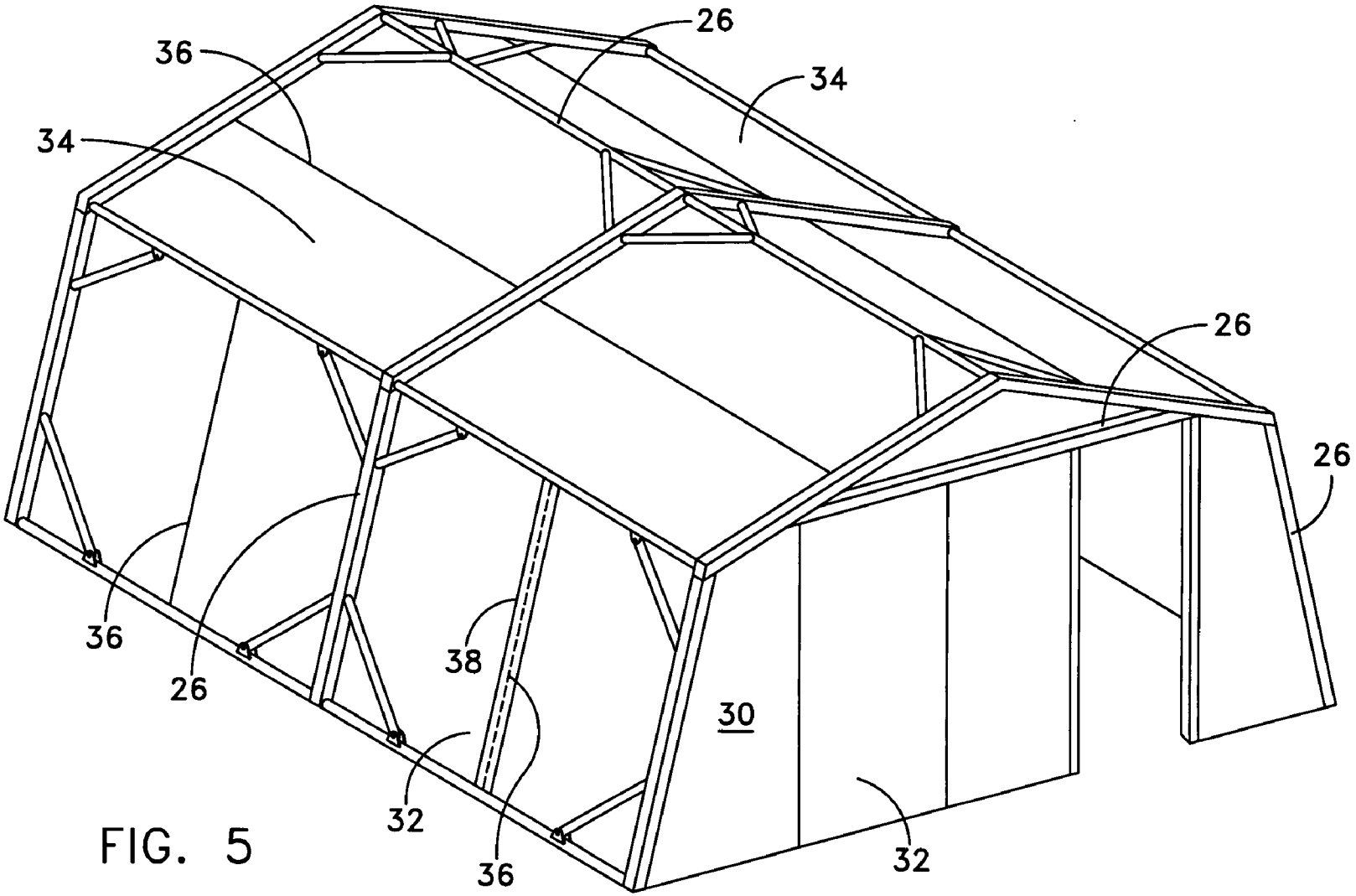
FIG. 5 is a perspective view of the inner portion of the ballistic protection shelter of FIG. 3, shown within the frame assembly of FIG. 1.

The illustrative shelter further includes an internal shelter structure 30 (FIG. 3) including at least rigid side wall panels 32 and, preferably, rigid roof panels 34. The rigid panels 32, 34 are interconnectable, and/or connectable to the frame assembly 26 (FIG. 5), for quick erection within the soft-walled structure 20. The rigid frame assembly 26 may support the soft wall portions 22 and the rigid side panels 32, or the rigid side panels 32 may stand by virtue of their own rigidity and interconnection.

The rigid panels 32, 34 may be interlocking with each seam 36 being covered by a lap 38 (a sample of such lapped seam being shown in FIG. 5) so that the lapped seams maintain the integrity of the protective shielding and any sliding doors (not shown).

In small structures, the frame assembly 26 may be omitted and the soft walled structure 20 supported by a traditional single central pole, or a line of central poles. In such instances, the internal shelter structure is self-supporting.

Figure 4:
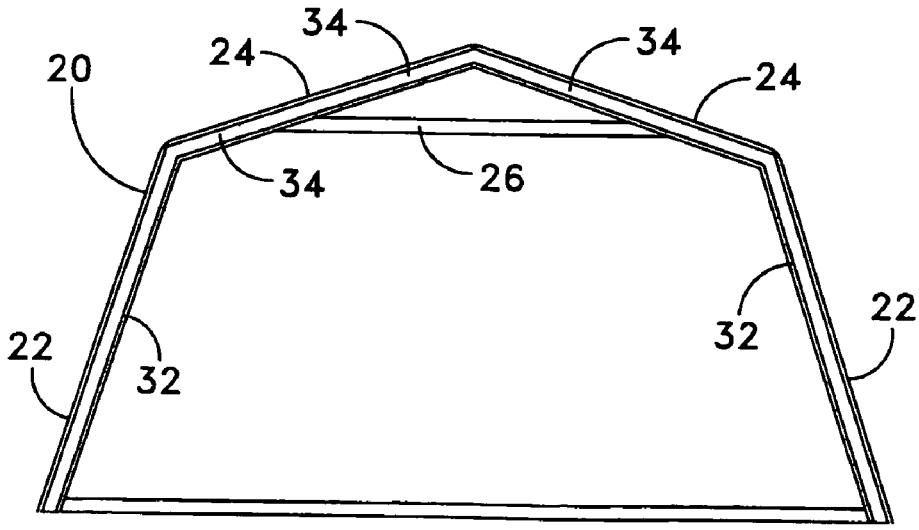
FIG. 4 is a sectional view taken along line IV-IV of FIG. 3.

There is thus provided a quickly erectable modular ballistic protective shelter which provides no obvious indication as to its "hardening". The shelter illustrated in FIG. 4 has the same appearance as the shelter of FIG. 2, the structure of FIG. 5 being disposed within the structure of FIG. 2, hidden from view.

The shelters are air transportable (C-130). The rigid panels 32, 34 are of off-the-shelf light-weight ballistic materials and the soft portions 22, 24 are of standard tent fabric. The frame assembly 26 is of standard tent frame construction and materials.

The present invention provides protection against fragment and blast overpressure risks associated with indirect fire threats. The invention inserts into a standard military tent without any special tools; it can be utilized with standard tent fabric covering; it does not change the shelter's signature; and it is designed to transfer the bulk of the structural loads associated with the ballistic panels directly to the ground.

It is to be understood that the present invention is by no means limited to the particular construction herein disclosed and/or shown in the drawings, but also comprises any modification or equivalent within the scope of the claims.

What is claimed is:

1. A ballistic protection shelter comprising:

a soft-walled shelter structure wherein soft wall and soft roof portions are supported on at least one rigid support member; and an internal shelter structure for disposition within said soft-walled shelter structure;

said internal shelter structure comprising rigid side wall panels, and rigid roof panels for underlying the soft roof portions, said roof portions being connectable to at least one of (1) each other and (2) the support member, to form an enclosure, said enclosure standing by virtue of its own rigidity and interconnection for transferring a bulk of structural loads associated with the panels directly to the ground;

said shelter having an outer appearance of a tent and having interior structure of interconnectable rigid panels, said panels being of a ballistic protective material adapted to provide protection to shelter occupants against blast overpressure, resulting from explosive detonations, and shrapnel.

2. The ballistic protection shelter in accordance with claim 1, wherein the soft wall and soft roof portions are of fabric material.

3. The ballistic protection shelter in accordance with claim 1, where the soft wall portions are supported by a frame assembly.

4. The ballistic protection shelter in accordance with claim 3, wherein said rigid side wall panels are supported by the frame assembly.

5. The ballistic protection shelter in accordance with claim 1, wherein said rigid panels are interlocking with lapped seams for maintaining integrity of the rigid panels, and any sliding door of the shelter.

* * * * *